US007791567B2

(12) United States Patent
Nam et al.

(10) Patent No.: US 7,791,567 B2
(45) Date of Patent: Sep. 7, 2010

(54) ORGANIC ELECTROLUMINESCENT DEVICE AND DRIVING METHOD THEREOF

(75) Inventors: Young Hee Nam, Seoul (KR); Hyun Jae Lee, Gumi (KR)

(73) Assignee: LG Display Co., Ltd., Seoul (KR)

( * ) Notice: Subject to any disclaimer, the term of this patent is extended or adjusted under 35 U.S.C. 154(b) by 864 days.

(21) Appl. No.: 11/435,768

(22) Filed: May 18, 2006

(65) Prior Publication Data

US 2007/0057880 A1 Mar. 15, 2007

(30) Foreign Application Priority Data

Sep. 15, 2005 (KR) ..... 10-2005-0086204
Oct. 19, 2005 (KR) ..... 10-2005-0098643

(51) Int. Cl.
*G09G 3/30* (2006.01)

(52) U.S. Cl. ..... 345/76; 345/77

(58) Field of Classification Search ..... 345/76–83; 315/169.3
See application file for complete search history.

(56) References Cited

U.S. PATENT DOCUMENTS

2002/0036605 A1 3/2002 Kawashima ..... 345/76
2002/0101179 A1* 8/2002 Kawashima ..... 315/169.3
2003/0030602 A1* 2/2003 Kasai ..... 345/76
2003/0038760 A1* 2/2003 Kim et al. ..... 345/76
2004/0207615 A1 10/2004 Yumoto ..... 345/211
2005/0280613 A1* 12/2005 Takei et al. ..... 345/76

FOREIGN PATENT DOCUMENTS

EP 1 091 340 A2 4/2001

* cited by examiner

*Primary Examiner*—Amr Awad
*Assistant Examiner*—Aaron Midkiff
(74) *Attorney, Agent, or Firm*—Morgan Lewis & Bockius LLP

(57) ABSTRACT

The present invention relates to an organic electroluminescent device and driving method thereof.

The method of driving an electroluminescent device having a plurality of pixels formed on emitting areas crossed by data lines and scan lines comprises detecting a gray scale of a data current according to a display data inputted from outside, and discharging the data lines to a discharging level corresponding to the display data according to the detected gray scale.

The organic electroluminescent device and driving method thereof according to the present invention can emit the pixels as desired brightness independently of a gray scale by making the discharging circuit regulate the discharge level according to the gray scale.

9 Claims, 7 Drawing Sheets

ORGANIC ELECTROLUMINESCENT DEVICE AND DRIVING METHOD THEREOF

BACKGROUND OF THE INVENTION

1. Field of the Invention

The present invention relates to an organic electroluminescent device and a driving method thereof. Particularly, the present invention relates to the organic electroluminescent device capable of changing a discharging level according to gray scale, and a driving method thereof.

2. Description of the Related Art

An organic electroluminescent device is a device emitting a light having a predetermined wavelength when a certain voltage is applied thereto.

FIG. 1 is a view showing an organic electroluminescent device in the art. And, FIG. 2 is a timing diagram showing scan signal and data current provided to pixels of FIG. 1.

In FIG. 1, the organic electroluminescent device in the art includes a panel 100, a scan driving circuit 110, a control circuit 120, a data driving circuit 130, a pre-charging circuit 140 and a discharging circuit 150.

The panel 100 includes a plurality of pixels E11 to E44 formed on an emitting area crossing over data lines D1 to D4 and scan lines S1 to S4.

The scan driving circuit 110 transmits scan signals to the pixels through the scan lines S1 to S4 in sequence.

The control circuit 120 receives a display data inputted from outside, for example, RGB data, and transmits a control signal to the scan driving circuit 110, the data driving circuit 130, the pre-charging driving circuit 140, and the discharging circuit 150 according to the display data.

Hereinafter, the driving method of the organic electroluminescent device will be described in detail.

But, for the convenience of explanation, it is assumed that a first display data and a second display data are inputted to the control circuit 120 in sequence.

The pre-charging circuit 140 applies a first pre-charge current according to the first display data provided from the control circuit 120 to the data lines D1 to D4 during a first pre-charge time pcha1 as shown in FIG. 2.

In this case, the first pre-charge current is sufficiently overshooting during the first pre-charge time pcha1 because the first display data is high gray scale (80%). Thus, the pixels E11 to E44 are emitting a light as the gray scale of 80% from the starting time T2 of a low logic area in the second scan signal SP2.

Then, the data driving circuit 130 provides a first data current (the gray scale of 80%) according to the first display data transmitted from the control circuit 120 to the pixels E11 to E44 through the data lines D1 to D4.

Subsequently, the discharging circuit 150 discharges the data lines D1 to D4 to a certain discharge level DL1 according to the first display data transmitted from the control circuit 120 during a second discharge time. The discharging circuit 150 is formed with a plurality of Zener diodes ZD1 to ZD4, and so the discharge level is uniformly fixed independently of the emitting gray scale of the pixels E11 to E44.

Next, the pre-charging circuit 140 applies a second pre-charge current according to the second display data provided from the control circuit 120 to the data lines D1 to D4 during a second pre-charge time pcha2.

Then, the data driving circuit 130 provides a second data current (the gray scale of 20%) according to the second display data transmitted from the control circuit 120 to the pixels E11 to E44 through the data lines D1 to D4.

In this case, the second pre-charge current is not sufficiently overshooting because the second display data is the low gray scale (20%). As a result, the pixels E11 to E44 emits as the gray scale of 20% after passing the starting time T3 of the low logic area in a third scan signal SP3, like the A area of FIG. 2

Thus, the pixels E11 to E44 could not emit a light with desired brightness.

In case a light is emitted in the low gray scale after the light is emitted in high gray scale as shown above, the pixels E11 to E44 could not emit a light with desired brightness, and the consumption power is increased to emit a light with desired brightness.

SUMMARY OF THE INVENTION

One object of the present invention is to provide an organic electroluminescent device which can emit a light with desired brightness independently of gray scale by making the discharging circuit regulate the discharge level according to the gray scale, and a driving method thereof.

Another object of the present invention is to provide an organic electroluminescent device which can emit the pixels as the brightness corresponding to gray scale by modifying a discharge level according to the gray scale by using a variable resistance, and a driving method thereof.

The light emitting device according to the present invention comprises a plurality of scan lines in a first direction, a plurality of data lines in a second direction different from the first direction, a panel having a plurality of pixels formed on emitting areas that the data lines and the scan lines cross, a control circuit which generates a control signal according to a first display data and a second display data inputted from outside in sequence, and a discharging circuit which discharges the data lines according to a control signal transmitted from the control circuit to a first discharging level corresponding to the first display data during a first discharging time according to the first display data, and discharges the data lines according to a second discharging level corresponding to the second display data during a second discharging time according to the second display data.

The light emitting device according to the present invention comprises a plurality of scan lines in a first direction, a plurality of data lines in a second direction different from the first direction, a panel having a plurality of pixels formed on emitting areas that the data lines and the scan lines cross, and a discharging circuit which discharges the data lines according to the first display data and a second display data inputted from outside in sequence to a first discharging level corresponding to the first display data during a first discharging time according to the first display data, and discharges the data lines according to a second discharging level corresponding to the second display data during a second discharging time according to the second display data.

The method of driving an electroluminescent device having a plurality of pixels formed on emitting areas crossed by data lines and scan lines comprises detecting a gray scale of a data current according to a display data inputted from outside, and discharging the data lines to a discharging level corresponding to the display data according to the detected gray scale.

The organic electroluminescent device and driving method thereof according to the present invention can emit the pixels as desired brightness independently of the gray scale by making the discharging circuit regulate the discharge level according to the gray scale.

The organic electroluminescent device and driving method thereof according to the present invention can emit the pixels as brightness corresponding to the gray scale by changing the discharge level according to the gray scale by using a variable resistance.

DETAILED DESCRIPTION OF THE INVENTION

The present invention will be more clearly understood from the detailed description in conjunction with the following drawings.

Figure 3:
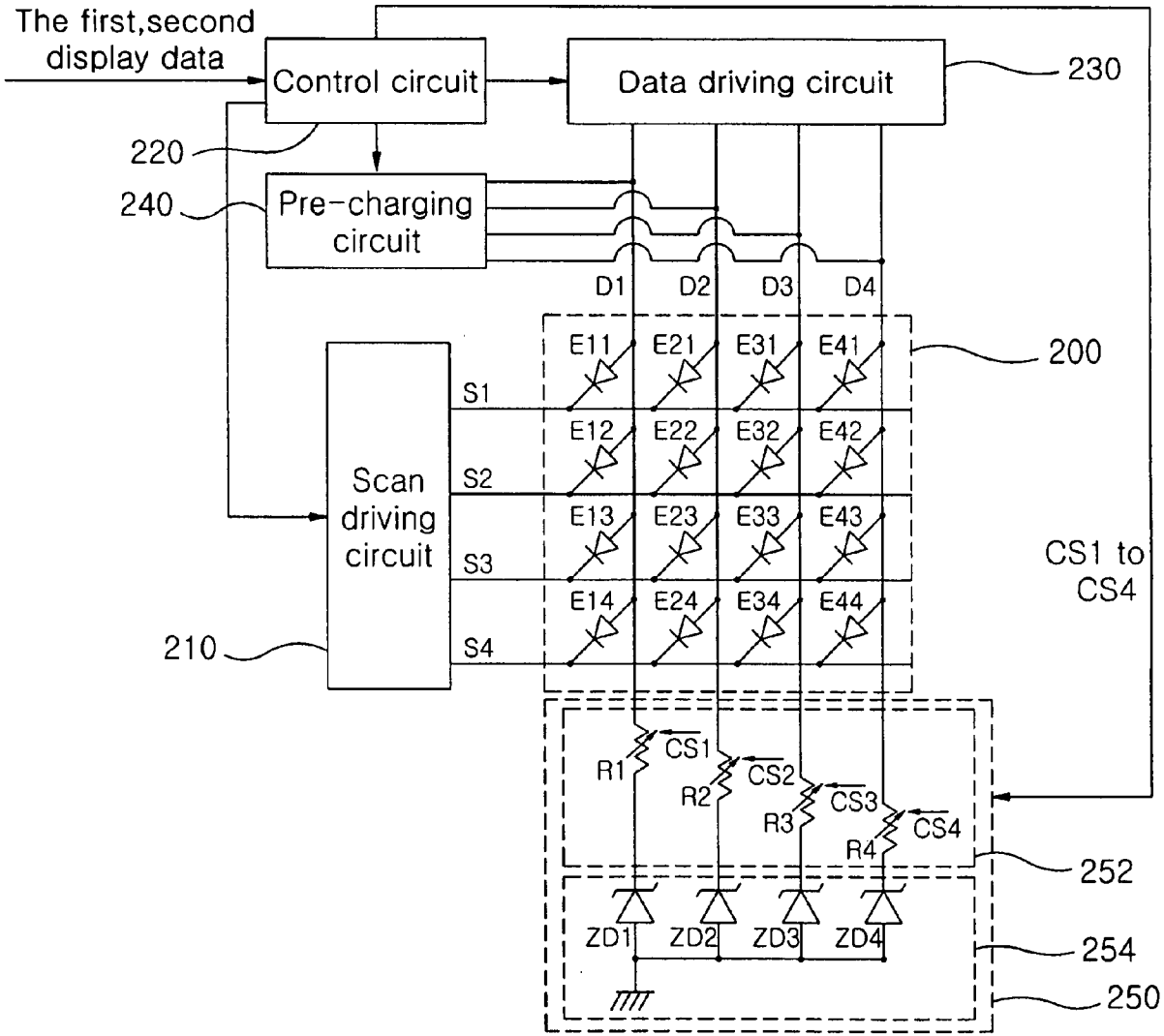
FIG. 3 is a view schematically showing the organic electroluminescent device according to the first embodiment of the present invention.
Figure 4:
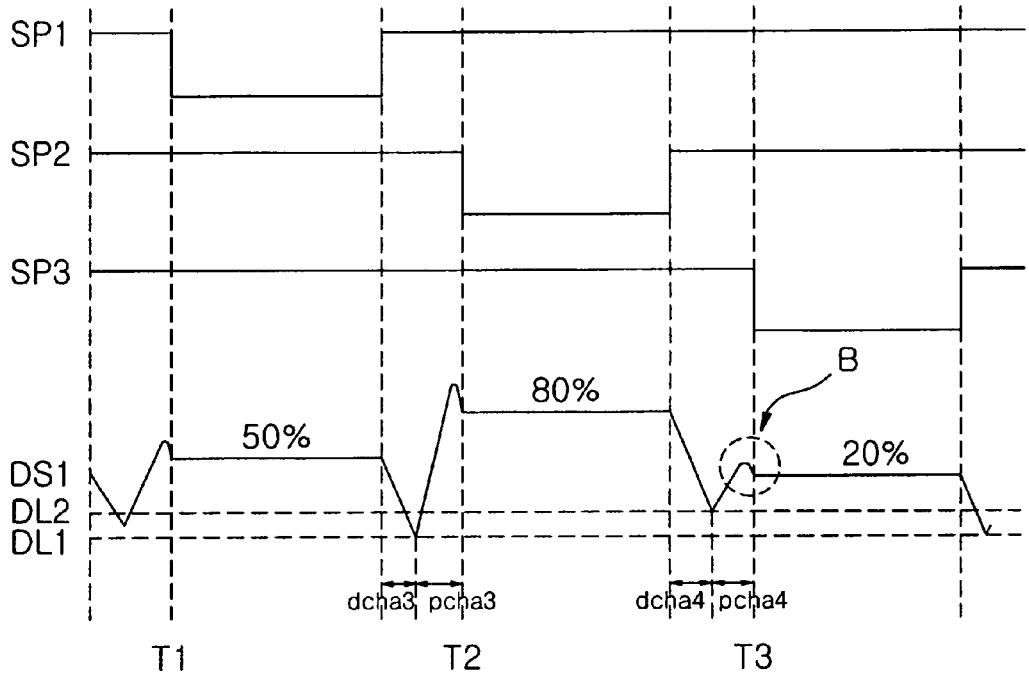
FIG. 4 is a timing diagram showing scan signal and data current provided to pixels of the organic electroluminescent device according to embodiments of the present invention.

FIG. 3 is a view schematically showing the organic electroluminescent device according to the first embodiment of the present invention. And, FIG. 4 is a timing diagram showing scan signal and data current provided to pixels of the organic electroluminescent device according to embodiments of the present invention.

In FIG. 3, the organic electroluminescent device according to the first embodiment of the present invention includes a panel 200, a scan driving circuit 210, a control circuit 220, a data driving circuit 230, a pre-charging circuit 240 and a first discharging circuit 250.

The panel 200 includes a plurality of pixels E11 to E44 formed on an emitting area crossing over data lines D1 to D4 and scan lines S1 to S4.

Each of the pixels E11 to E44 is formed with an anode electrode layer, an organic layer and a cathode electrode layer, and emits a light having a certain wavelength when a positive voltage is applied to the anode electrode layer and a negative voltage is applied to the cathode electrode layer.

The scan driving circuit 210 provides scan signals to scan lines S1 to S4 in sequence.

In detail, the scan driving circuit 210 provides the scan signals, each having a low logic area and a high logic area, to the scan lines S1 to S4. As a result, the pixels E11 to E44 emit a light at the low logic area in the scan signals.

The control circuit 220 receives a display data inputted from outside, that is, RGB data. Also, the control circuit 220 transmits control signals to the scan driving circuit 210, the data driving circuit 230, the pre-charging circuit 240, and the discharging circuit 250 according to the display data inputted in sequence.

Hereinafter, it is assumed that a first display data and a second display data are inputted in sequence.

The pre-charging circuit 240 receives the first display data from the control circuit 220, and applies a first pre-charge current according to the received first display data to the data lines D1 to D4.

The data driving circuit 230 provides a first data current according to the first display data provided from the control circuit 220 to each of the data lines D1 to D4 to which a first pre-charge current is applied. Here, the data currents are synchronized with the scan signals.

On the other hand, the control circuit 220 detects a gray scale according to the received first and second display data. The control circuit 220 provides control signals CS1 to CS4 controlling the discharge level by using the detected gray scale information to the first discharging circuit 250.

In detail, the control circuit 220 determines whether the detected gray scale is high gray scale (for example, whether the gray scale is more than 50%).

In case the detected gray scale is the high gray scale, for example, the gray scale according to the second display data is 80% as shown in FIG. 4, the control circuit 220 provides the control signals CS1 to CS4 instructing the first discharging circuit 250 to decrease the discharge level according to the second display data.

On the other hand, in case the detected gray scale is the low gray scale, for example, the gray scale according to the second display data is 20% as shown in FIG. 4, the control circuit 220 provides the control signals CS1 to CS4 instructing the first discharging circuit 250 to increase the discharge level according to the second display data.

The first discharging circuit 250 includes a first discharge performing circuit 252 and a second discharge performing circuit 254.

The first and second discharge performing circuits 252, 254 discharge the data lines D1 to D4 to which the data current is provided according to the first and second display data provided from the control circuit 220, to a discharge level (first and second discharge levels) corresponding to the second display data.

The first discharge performing circuit 252 receives the control signals CS1 to CS4 from the control circuit 220, and changes the first discharge level according to the control signals CS1 to CS4. In detail, the first discharge performing circuit 252 is formed with a plurality of variable resistances R1 to R4, and changes the first discharge level by changing resistance value of the variable resistances R1 to R4 according to the control signals CS1 to CS4.

For example, in case the control signals CS1 to CS4 instruct to increase the first discharge level, the first discharge performing circuit 252 increases resistance value of the variable resistances R1 to R4. But, in case the control signals instruct to decrease the first discharge level, the first discharge performing circuit 252 decreases resistance value of the variable resistances R1 to R4. The first discharge performing circuit 252 discharges the data lines D1 to D4 to the first discharge level according to voltage value applied to the variable resistances R1 to R4.

The second discharge performing circuit 254 discharges the data lines D1 to D4 to the second discharge level. The second discharge performing circuit 254 is formed with a plurality of Zener diodes ZD1 to ZD4 so that it can discharge the data lines D1 to D4 up to the second discharge level independently of gray scale of the second display data.

Hereinafter, the driving method of the organic electroluminescent device according to the first embodiment will be described as follows.

Figure 5:
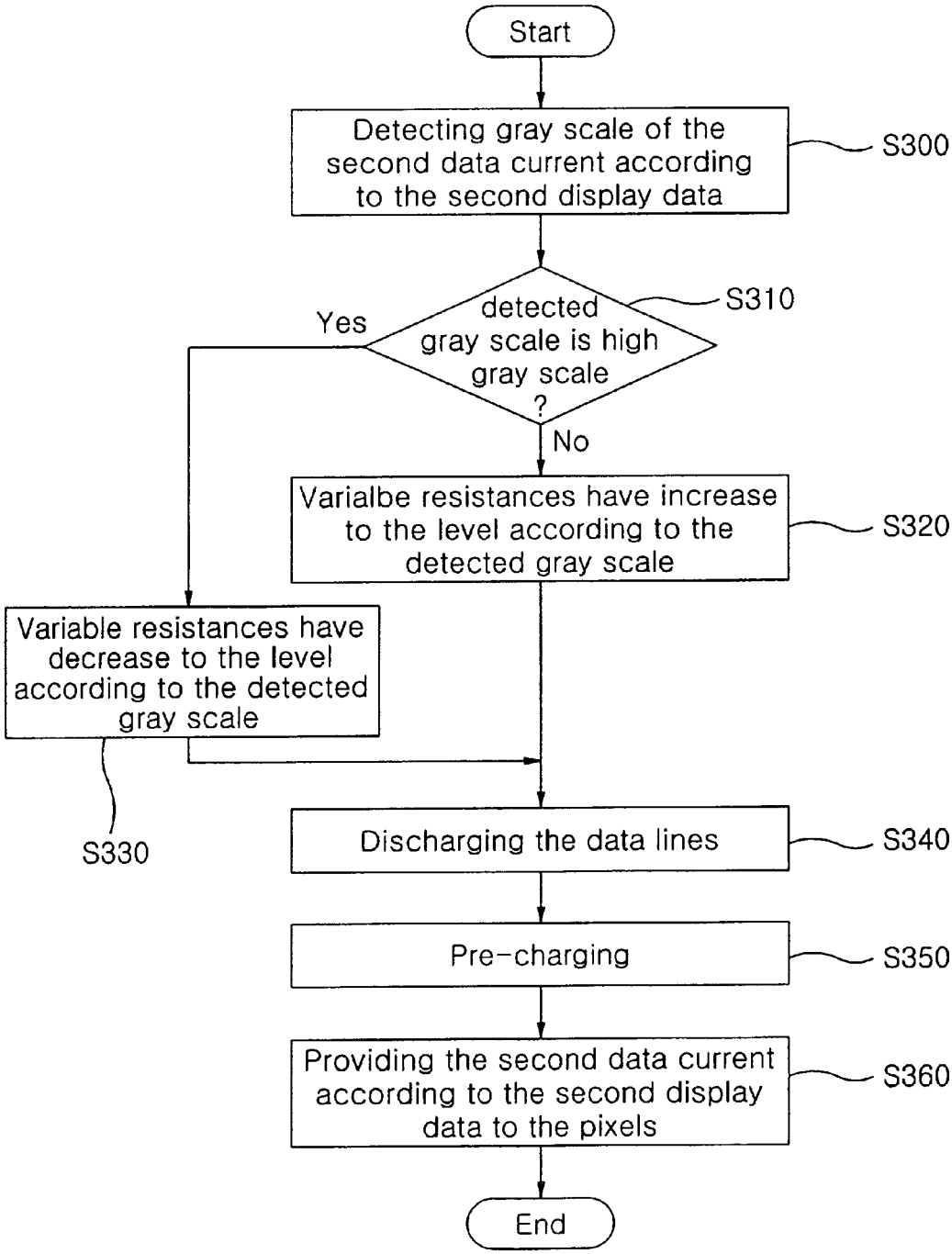
FIG. 5 is a flow diagram showing the driving method of the organic electroluminescent device according to a first embodiment of the present invention.

FIG. 5 is a flow diagram showing the driving method of the organic electroluminescent device according to the first embodiment of the present invention.

In FIG. 5, first, in the step of S300, the control circuit 220 detects a gray scale according to the second display data received from outside.

Next, in the step of S310, the control circuit 220 determines whether the detected gray scale is high gray scale (for example, whether the gray scale is more than 50%) or not.

In case the detected gray scale is the high gray scale, for example, the gray scale according to the second display data is 80% as shown in FIG. 4, the control circuit 220 provides the control signals CS1 to CS4 instructing the first discharging circuit 252 to decrease resistance value of the variable resistances R1 to R4 according to the detected gray scale. In this case, it is also fine to provide the control signals CS1 to CS4 instructing to maintain resistance value of the variable resistances R1 to R4 as a predetermined value.

In the step of S330, then, the first discharge performing circuit 252 decreases resistance value of the variable resistances R1 to R4 according to the control signals CS1 to CS4.

On the other hand, in case the detected gray scale is the low gray scale, for example, the gray scale according to the second display data is 20% as shown in FIG. 4, the control circuit 220 provides the control signals CS1 to CS4 instructing the first discharging circuit 252 to increase resistance value of the variable resistances R1 to R4 according to the detected gray scale.

In the step of S320, then, the first discharge performing circuit 252 increases resistance value of the variable resistances R1 to R4 according to the control signals CS1 to CS4.

Then, in the step of S340, the first and second discharge performing circuits 252, 254 discharge the data lines D1 to D4 to a discharge level according to the second display data (the gray scale of 80% is DL1, and the gray scale of 20% is DL2).

Next, in the step of S350, the pre-charging circuit 240 applies the pre-charge current according to the second display data to the data lines D1 to D4.

Then, in the step of S360, the data driving circuit 230 provides the data current according to the second display data to the pixels E11 to E44 through the data lines D1 to D4.

In short, it is possible to regulate the discharge level by changing resistance value of the variable resistances R1 to R4 in the first discharge performing circuit 252 according to a gray scale of the display data. Thus, even when the organic electroluminescent device emits a light by changing the brightness from high gray scale to low gay scale, it can emit a light as gray scale corresponding to the display data at the starting time T3 of the low logic area of the scan signal as shown B area in FIG. 4.

Hereinafter, the organic electroluminescent device according to the second embodiment of the present invention and driving method thereof will be described as follows.

Figure 6:
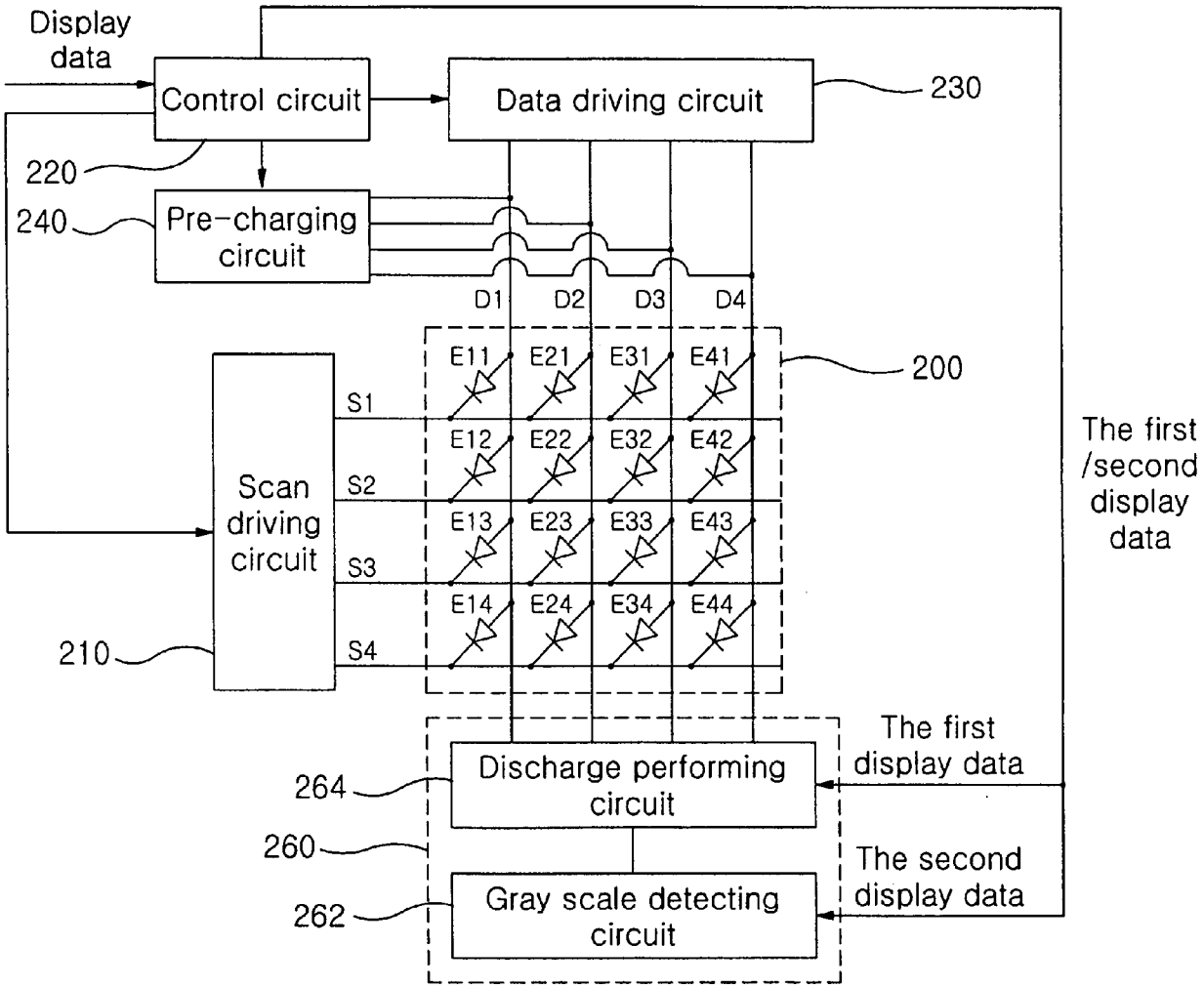
FIG. 6 is a view schematically showing the organic electroluminescent device according to a second embodiment of the present invention.

FIG. 6 is a view schematically showing the organic electroluminescent device according to the second embodiment of the present invention.

In FIG. 6, the organic electroluminescent device according to the second embodiment of the present invention includes the panel 200, the scan driving circuit 210, the control circuit 220, the data driving circuit 230, the pre-charging circuit 240 and a second discharging circuit 260.

Hereinafter, other constitutions than the second discharging circuit 260 are the same as the organic electroluminescent device according to the first embodiment, and so the explanations thereon are omitted below.

Hereinafter, it is assumed that a first display data and a second display data are inputted in sequence.

The pre-charging circuit 240 receives the first display data from the control circuit 220, and applies a first pre-charge current according to the received first display data to the data lines D1 to D4.

The data driving circuit 230 provides a first data current according to the first display data provided from the control circuit 220 to the data lines D1 to D4 to which a first pre-charge current is applied.

The second discharging circuit 260 includes a gray scale detecting circuit 262 and a discharge performing circuit 264.

The gray scale detecting circuit 262 receives the second display data from the control circuit 220, detects a gray scale according to the received second display data, and transmits the detected gray scale information to the discharge performing circuit 264.

In detail, the discharge performing circuit 264 determines whether the detected gray scale is high gray scale (for example, the gray scale is more than 50%) by the transmitted gray scale information. In case the detected gray scale is the high gray scale, for example, the gray scale according to the first display data is 50%, and the gray scale according to the second display data is 80% as shown in FIG. 4, the discharge performing circuit 264 discharges the data lines D1 to D4 to which the first data current is provided according to the first display data transmitted from the control circuit 220 to the fixed first discharge level DL1.

In this case, the discharge performing circuit 264 discharges the data lines D1 to D4 to the first discharge level DL1 independently of the gray scale.

But, in case the detected gray scale is the low gray scale, for example, the gray scale according to the first display data is 80%, and the gray scale according to the second display data is 20% as shown in FIG. 4, the discharge performing circuit 264 discharges the data lines D1 to D4 according to the first display data to the second discharge level DL2.

In this case, the discharge performing circuit 264 discharges the data lines D1 to D4 to the discharge level corresponding to the gray scale.

For example, when the detected gray scale is 40%, the discharge performing circuit 264 discharges the data lines D1 to D4 to a discharge level between the first discharge level DL1 and the second discharge level DL2.

The discharge performing circuit 264 according to one embodiment of the present invention discharges the data lines D1 to D4 to the discharge levels DL1 and DL2 by controlling the discharge times dcha1 and dcha2.

Also, the discharge performing circuit 264 can discharge the data lines D1 to D4 to the discharge levels DL1 and DL2 by controlling the discharge amount during same time.

The pre-charging circuit 240 applies the second pre-charge current according to the received second display data to the discharged data lines D1 to D4.

The data driving circuit 230 provides the second data current according to the second display data transmitted from the control circuit 220 to the data lines D1 to D4 to which the second pre-charge current is applied.

Hereinafter, the driving method of the organic electroluminescent device according to the second embodiment will be described as follows.

Figure 7:
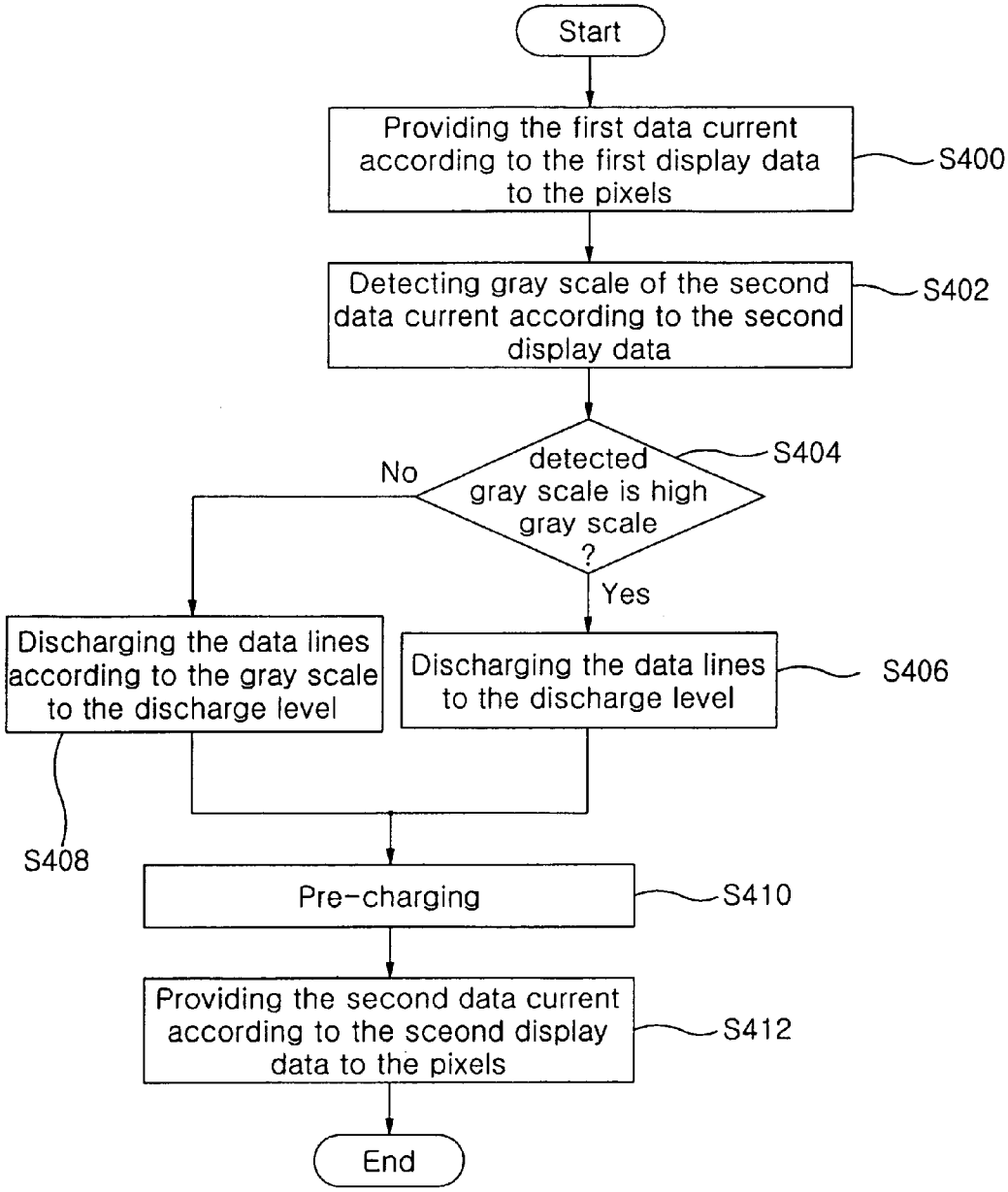
FIG. 7 is a flow diagram showing the driving method of the organic electroluminescent device according to the second embodiment of the present invention.

FIG. 7 is a flow diagram showing the driving method of the organic electroluminescent device according to the second embodiment of the present invention.

In FIG. 7, in the step of S400, the data driving circuit 230 provides the first data current according to the first display data to the pixels E11 to E44 through the data lines D1 to D4.

Then, in the step of S402, the gray scale detecting circuit 262 detects a gray scale according to the second display data.

Next, in the step of S404, the gray scale detecting circuit 262 determines whether the detected gray scale is high gray scale or not.

In the step of S406, in case the detected gray scale is the high gray scale, the discharge performing circuit 264 discharges the data lines D1 to D4 to the fixed first discharge level D1.

On the other hand, in the step of S408, in case the detected gray scale is the low gray scale, the discharge performing circuit 264 discharges the data lines D1 to D4 to a discharge level corresponding to the detected gray scale S408.

Next, in the step of S410, the pre-charging circuit 240 applies the pre-charge current according to the second display data to the data lines D1 to D4.

Then, in the step of S412, the data driving circuit 230 provides the data current according to the second display data to the pixels E11 to E44 through the data lines D1 to D4.

Hereinafter, the organic electroluminescent device of the present invention will be compared with one in the art.

Figure 1:
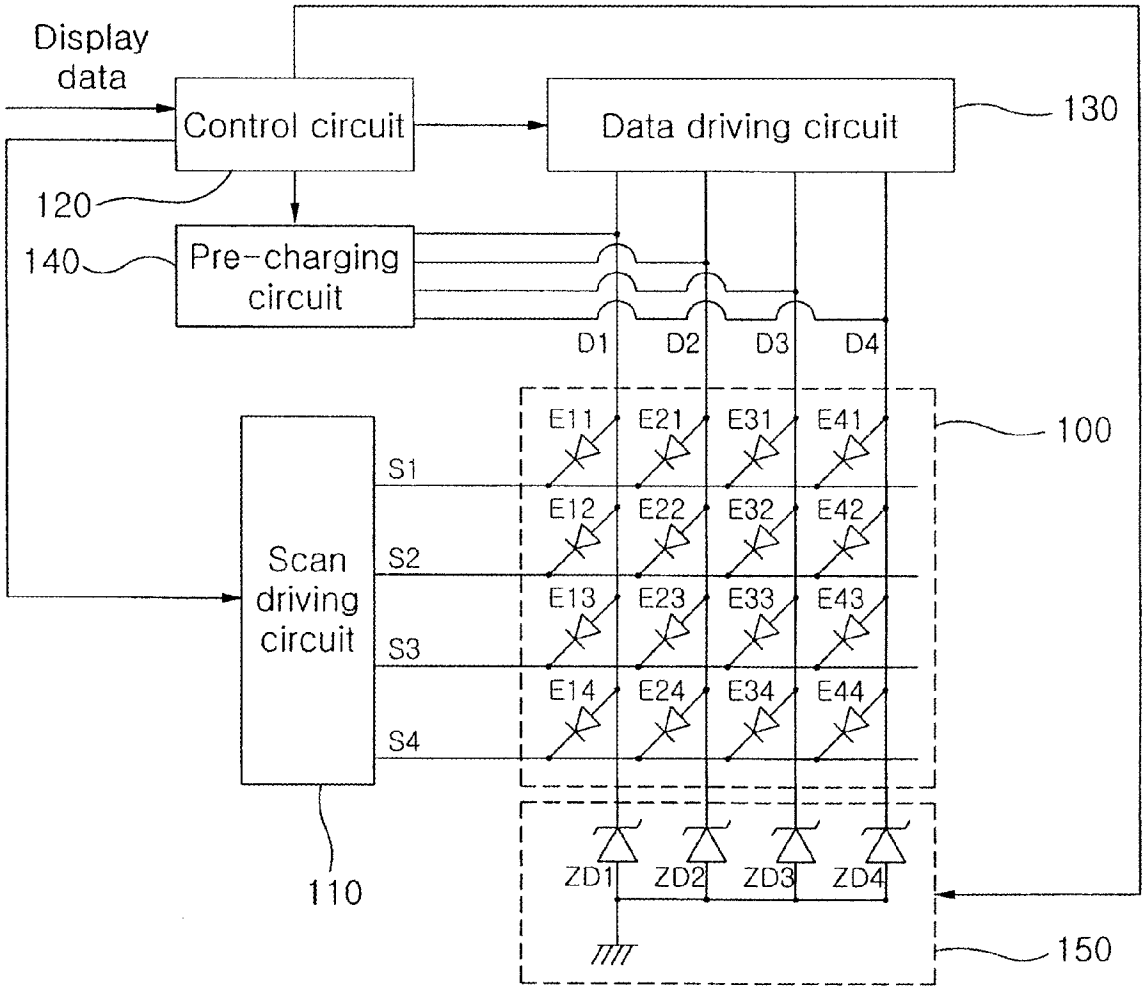
FIG. 1 Related Art
FIG. 1 is a view showing an organic electroluminescent device in the art.
Figure 2:
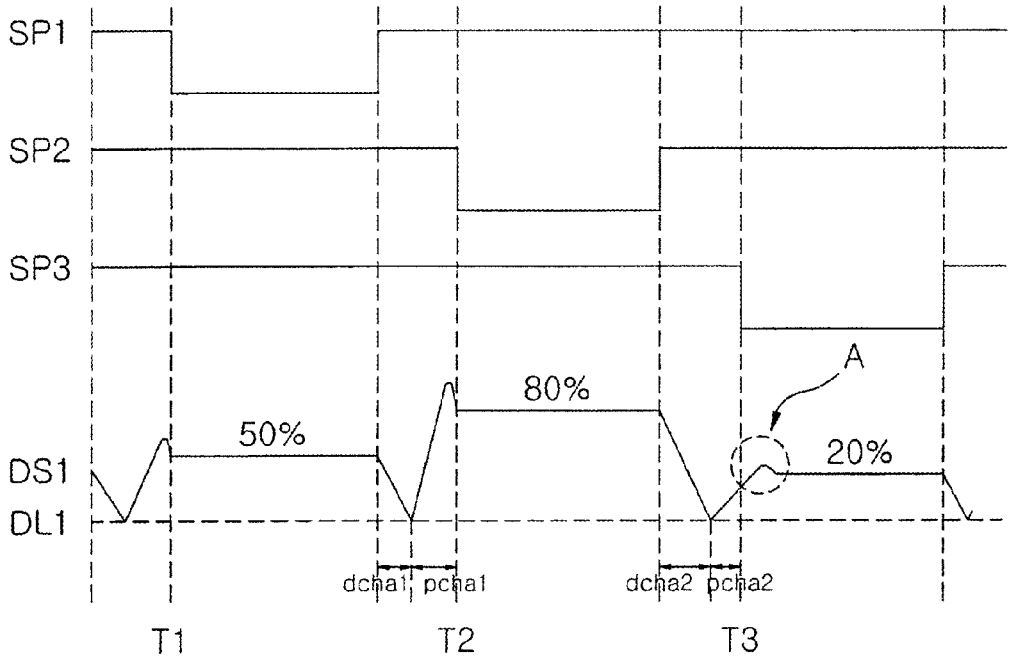
FIG. 2 Related Art
FIG. 2 is a timing diagram showing scan signal and data current provided to pixels of FIG. 1.

In the organic electroluminescent device in the art, the discharge level is always same independently of gray scale. Thus, in case the gray scale according to the second display data is low gray sale, a smaller amount of current than desired one is provided to the data lines D1 to D4 at the low logic area of the scan signal as shown in A area of FIG. 2.

Thus, the organic electroluminescent device in the art emits a light of lower brightness than desired one, and so desired brightness is achieved by increasing power.

However, in the organic electroluminescent device of the present invention, the discharge level is changed according to the gray scale corresponding to the second display data. Thus, in case the gray scale according to the second display data is low gray scale, a desired data current is provided to the data lines D1 to D4 at the low logic area of the scan signal as shown in B area of FIG. 4.

Therefore, the organic electroluminescent device of the present invention need not increase power unlike one in the art, and so the consumption power is decreased.

From the preferred embodiments for the present invention, it should be noted that modifications and variations can be made by a person skilled in the art in light of the above teachings. Therefore, it should be understood that changes may be made for a particular embodiment of the present invention within the scope and spirit of the present invention outlined by the appended claims.

What is claimed is:

1. A light emitting device, comprising:

a plurality of scan lines in a first direction;

a plurality of data lines in a second direction different from the first direction;

a panel having a plurality of pixels formed on emitting areas that the data lines and the scan lines cross; and a control circuit which detects a gray scale of a first display data and a second display data inputted from outside in sequence and generates a plurality of control signals for controlling a discharge level according to the detected gray scales;

a discharging circuit including a plurality of zener diodes and a plurality of variable resistors connected between the data lines and a ground in serial, wherein the discharging circuit selectively discharges the data lines to one of a first discharging level and a second discharging level by changing resistance values of the variable resistors according to the plurality of control signals transmitted from the control circuit during a discharging time; and a pre-charge circuit which provides a pre-charge current to the data lines according to the first and second display data received from the control circuit during a pre-charging time after the discharge time.

2. The device of claim 1, wherein the control circuit provides the variable resistors with a control signal instructing to decrease resistance values of the variable resistors so that the discharging level corresponds to the second display data, when the second display data is high gray scale data.

3. The device of claim 1, wherein the control circuit provides the variable resistors with a control signal instructing to increase resistance values of the variable resistors so that the discharging level corresponds to the second display data, when the second display data is low gray scale data.

4. The device of claim 1, further including:

a scan driving circuit which provides scan signals to the scan lines; and a data driving circuit which receives the first and second display data, and provides first and second data currents according to the received first and second display data to the data lines.

5. The device of claim 1, wherein the device is an organic electroluminescent device.

6. A method of driving an electroluminescent device having a plurality of pixels formed on emitting areas crossed by data lines and scan lines, comprising:

(a) detecting a gray scale of a data current according to a display data inputted from outside;

(b) generating a control signal for controlling a discharge level according to the detected gray scale;

(c) selectively discharging the data lines, using a discharging circuit including a plurality of Zener diodes and a plurality of variable resistors connected between the data lines and ground in serial, to one of a first discharging level and a second discharging level by changing resistance values of the variable resistors according to the control signal during a discharging time; and (d) providing a pre-charge current to the data lines according to the display data during a pre-charging time after the discharge time.

7. The method of claim 6, wherein the step of (c) comprises:

decreasing resistance values of variable resistors included in a discharging circuit so that the discharging level corresponds to the display data when the detected gray scale is high gray scale; and discharging the data lines to the discharging level.

8. The method of claim 6, wherein the step of (b) comprises:

increasing resistance values of variable resistors included in a discharging circuit so that the discharging level corresponds to the display data when the detected gray scale is low gray scale; and discharging the data lines to the discharging level.

9. The method of claim 6, further comprising:

providing a data current to the data lines to which the pre-charge current is applied according to the display data.

* * * * *